US008347869B2

(12) United States Patent
Sims et al.

(10) Patent No.: US 8,347,869 B2
(45) Date of Patent: Jan. 8, 2013

(54) COMPOUND ARCHERY BOWS

(75) Inventors: Steven C. Sims, Shelton, WA (US); Greg Winters, Shelton, WA (US); Gary Sims, Shelton, WA (US); Jonathan Seil, Shelton, WA (US); Arden Merriman, Shelton, WA (US); Scott Eastman, Olympia, WA (US)

(73) Assignee: Sims Vibration Laboratory, Inc., Shelton, WA (US)

( * ) Notice: Subject to any disclaimer, the term of this patent is extended or adjusted under 35 U.S.C. 154(b) by 850 days.

(21) Appl. No.: 12/287,506

(22) Filed: Oct. 9, 2008

(65) Prior Publication Data

US 2009/0145411 A1 Jun. 11, 2009

Related U.S. Application Data

(60) Provisional application No. 60/998,679, filed on Oct. 12, 2007.

(51) Int. Cl.
*F41B 5/00* (2006.01)
*F41B 5/10* (2006.01)

(52) U.S. Cl. ..... 124/23.1; 124/25.6

(58) Field of Classification Search ..... 124/23.1, 124/25.6

See application file for complete search history.

(56) References Cited

U.S. PATENT DOCUMENTS

| | | | | | |
|---|---|---|---|---|---|
| 224,043 | A | * | 2/1880 | Robinson | 124/23.1 |
| 3,766,904 | A | * | 10/1973 | Izuta | 124/23.1 |
| 3,965,883 | A | * | 6/1976 | Meyer | 124/23.1 |
| 4,183,345 | A | * | 1/1980 | Caldwell | 124/25.6 |
| 4,644,929 | A | * | 2/1987 | Peck | 124/23.1 |
| 4,762,112 | A | * | 8/1988 | Johnston | 124/86 |
| 5,231,970 | A | * | 8/1993 | Ploot et al. | 124/23.1 |
| 5,339,790 | A | * | 8/1994 | Smith | 124/25.6 |
| 5,706,794 | A | * | 1/1998 | Neal | 124/25.6 |

* cited by examiner

*Primary Examiner* — John Ricci
(74) *Attorney, Agent, or Firm* — Wells St. John PS

(57) ABSTRACT

Quiet, lightweight, well-balanced, forgiving, and accurate compound archery bows which have significantly reduced vibration and bow jump. The limbs and cams of these bows can be removed and replaced without a bow press, and the limbs of the bows are functional (active) over essentially their entire length and allow one to obtain equivalent performance from a more compact and lighter bow. The bow limbs may be leverage locked in articulated limb pockets. The limb butts extend forward well beyond the front of the riser. This eliminates limb length and limb angle as major factors in determining brace height, allowing one to choose a riser style and limb length which optimize arrow speed and bow stabilization. Novel adjustment mechanisms allow one to easily adjust the poundage or poundage and brace height of the bow. Vibration isolation systems may be employed to isolate the bow riser from the limb pockets. Bows with translating pockets, bows with stationery pockets and articulated risers, asymmetric bow limbs, and solid bow limbs with double belly cuts are also disclosed.

14 Claims, 16 Drawing Sheets

COMPOUND ARCHERY BOWS

CROSS-REFERENCE TO A RELATED APPLICATION

This application is with provisional application No. 60/998,679, filed Oct. 12, 2007. The priority of the provisional application is claimed.

TECHNICAL FIELD OF THE INVENTION

The present invention relates to novel, improved, compound archery bows.

DEFINITIONS

Belly Cut: A thinned segment of a bow limb which determines a location where a limb will flex and controls the degree of flex. The thinned segment provides a stress-distributing working area for stresses imposed on the limb as the bow is drawn. The belly cut can be made by cutting the limb material or by molding or any other appropriate manufacturing process.

Bow Jump: The tendency of a bow to escape the shooter's hand when an arrow is released, the limbs of the bow accelerating forward, then coming to an abrupt stop and exerting a forward-acting force on the bow.

Brace Height: The longest distance between the back of the bow grip and the bow string when the bow is at rest.

Draw Cycle: Begins with the drawing of a bow and continues through the launching of an arrow and the subsequent return of bow components to their "at rest" positions and configurations.

Front and Back: Respectively, the side of the bow facing the target and the side facing the shooter when the bow is in the shooting position.

Multi-Point Limb Pocket System: One as disclosed herein which uniquely affords a wide range of poundage adjustment and, in some instances, quick and easy adjustment of brace height; the representative and unique multi-point limb pocket systems disclosed herein have four possible points. As viewed from the side of the limb, these are: (1) a limb butt; (2) a central fulcrum axis; (3) a limb pocket pivot axis; and (4) a limb pocket drive point which is the axis of symmetry of a limb-pocket mounted component of a system employed to adjust the poundage (or poundage and brace height) of a bow by changing the angle of the limb pocket relative to a bow riser.

Poundage: The maximum force required to draw a bow.

Deflex Riser: One in which the grip is in front of a straight line drawn through the fulcrums of the upper and lower bow limbs.

Reflex Riser: One in which the grip is behind a straight line drawn through the fulcrums of the upper and lower bow limbs.

Split Limb Bow: A term used herein to identify a bow with paired upper limb components and paired lower limb components. The paired limb components are referred to in this document as limb branches. A bow with paired upper and paired lower limbs can be described as a four-limb bow.

Straight Riser: One in which the grip lies along a straight line drawn through the fulcrums of the upper and lower bow limbs.

BACKGROUND OF THE INVENTION

Compound bows are a relatively recent development. It has been reported that the first patent on a compound bow is U.S. Pat. No. 3,486,495 issued 30 Dec. 1969 to H. W. Allen.

Modern compound bows are instruments of considerable sophistication and not insignificant complexity.

A conventional bow of this type has a rigid riser with a grip for the archer and flexible limbs extending in opposite directions from the ends of the riser. A rotatable cam and a wheel (single cam bow) or two rotatable cams (double cam and hybrid cam bows) are mounted to and move with the tips of the flexible bow limbs as the bow is drawn and as the bow string subsequently released.

A bow string is connected between the cams, which rotate in opposite directions when the bow is drawn. As the bow is drawn, the bow string moves away from the riser of the bow; and the bow limbs are bent or flexed, storing potential energy which is converted to kinetic energy and used to accelerate the arrow when the bow string is released.

In the almost 40 years since the Allen patent was issued, many compound bow improvements have been made. Nevertheless, the search for a better compound bow continues.

SUMMARY OF THE INVENTION

Such bows are disclosed herein.

The bows of the present invention are quieter, lighter, better balanced, more forgiving, more accurate (especially at longer ranges), and vibrate less than typical, commercially available compound bows. Bow jump is dramatically reduced, and the need for a bow press is eliminated.

The foregoing and other significant advantages of the bows disclosed herein are attributable to a number of physical characteristics. Among these are limbs having butts which extend beyond the front of the bow and a system for attaching the limb to the bow riser which results in the limb being active over its entire length.

The limbs may be leverage locked to the bow riser in limb pockets which likewise extend well beyond the front side of the riser. In one preferred embodiment of the invention, the limb pockets are supported on transversely extending pivot members, and the butts of the limbs are leverage locked in the pockets by interlocking component limb butt anchoring systems uniquely located at the butts of the limbs and by forces which are imposed on the limbs by tensioning the buss/control cables of the bow and/or the bow string to lock the components of the butt anchoring systems together.

Eliminating the need to substantially reflex the riser and permitting a nearly straight riser to instead be employed is significant from the viewpoints of weight, balance, structural integrity and aesthetics. Furthermore, bows with nearly straight risers tend to be easier to shoot and more forgiving than those with significantly reflexed risers; and, unlike a reflexed riser, a nearly straight riser does not exaggerate torque attributable to the way the archer grips the bow. Furthermore, the brace height, the axle-to-axle distance between the upper and lower cams of the bow, the length of the bow limbs, and other parameters can be changed without changing the riser of the bow; i.e., numerous configurational changes including but not limited to those enumerated above can be made, using the exact same riser. Using a limb which extends beyond the front of the bow riser allows one to change the brace height of the bow without replacing any of a bow's components. This, among other things, offers a very significant reduction in manufacturing costs.

The leverage locking systems which secure the limb butts in the limb pockets eliminate the need for limb bolts or other mechanical attachments, which makes that segment of the limb extending beyond butt anchoring system and the front of the riser to the limb butt a functional, active, working part of the limb; i.e., a limb segment that can be bent (or flexed) and thereby stressed to store potential energy when the bow is drawn, this energy being converted to valuable kinetic energy when the bow string is released. This contrasts markedly with bow limb retaining systems which employ fasteners. In such bows, the butt end segment of a limb lying forward of the fastener is non-functional as far as the storing of potential energy is concerned.

Elimination of limb bolts or other limb-penetrating fasteners has the further advantage of eliminating vibration transferred from the limb to the riser by the fastener when an arrow is launched. The weakening of the limb by a fastener-receiving hole is avoided.

The limb butt anchoring system is preferably located at the very front or forward end of the limb. This allows the limb butt to pivot throughout the draw cycle of the bow, advantageously making the limb active over its entire length as discussed above. That and limb-engaged fulcrums in the limb pockets about which the limbs are flexed when the bow is drawn make essentially the entire length of each limb active in contrast to the conventional arrangement in which the butt segment of the limb has no useful function except as it is used in securing the limb in place in the pocket.

Making the butt of the limb live allows one to obtain equivalent performance from a shorter limb, resulting in a more compact and lighter bow. The limb butt anchoring system also keeps the butt of the limb from moving in a longitudinal direction and from side to side in the limb pocket. Also, the novel, just described arrangement eliminates the need to significantly reflex the riser, permitting a nearly straight riser to instead be employed, which is advantageous for the reasons discussed above.

Other compound bows with pivoting pockets have a two-point pocket system in which the limb pocket is pivoted on the riser near the limb butt or near a fulcrum at the rear of the pocket and in which the limb pocket drive point is similarly located near the limb butt or the fulcrum. Bows with pivoting pockets as disclosed herein have a unique limb pocket system with at least three points in which the limb pocket pivot point or the limb pocket drive point about which the pocket is driven to load the bow is at a third location which is distant from both the butt of the limb and the fulcrum An important advantage of this arrangement is that the limb pocket may be pushed or pulled from the back or the front of the bow to pivot the limb pocket about the limb pocket axis relative to the riser and thereby load the bow. Which approach is used depends on whether the limb pocket drive point is above or below the limb pocket pivot point.

The use of pivoting limb pockets as disclosed in this document to load the limb instead of loading the limb directly as is conventionally done gives one more flexibility in designing the geometry of the limbs; allows the angle of the limbs relative to the riser to be more effectively adjusted; and allows limbs of quite different geometries, materials, etc. to be used without altering the riser or the limb pockets.

The advantages of the above-discussed method of pivoting limb pockets can also be obtained in bows which do not have pivotable limb pockets. Limbs with translating pockets and bows which have fixed limb pockets and articulated risers are examples of such alternate configurations.

Both a half-round or other male component of the limb butt anchoring system and the roller, sliding, or equivalent fulcrum can be fabricated from a material capable of reducing the vibrations set up when an arrow is launched. This reduces wear and also makes for a much quieter, more accurate, and easier to shoot bow. The use of a roller fulcrum or one on which the limb can slide is also important because that part of the limb in the pocket moves many thousandths of an inch (typically 50-150) when the bow is drawn and as the limb returns to its original position and configuration concomitant with arrow release. The fulcrum provides for free movement of the limb, avoiding the imposition of unwanted, deleterious stresses on the limb.

The limb butt anchoring system and the roller or slide (or other fulcrum) allow the load imposed on the limb as the bow is drawn to be distributed over the entire length of the limb, instead of only along that part of the limb protruding beyond the pocket as is the case with a conventional compound bow. This significantly reduces the chances that the limb might break when the bow is drawn and significantly lengthens the useful service life of the limb.

Many other important advantages flow from this novel limb pocket or equivalent mounting arrangement. One is a wide range over which the poundage of the limb can be adjusted. Importantly, the poundage can be decreased all the way to zero, allowing one to remove a limb or cam or replace a bow string without a bow press, a particular advantage to one in the field. A related advantage is that no limb bolts or other fasteners have to be removed to free the limbs.

Another important advantage of the subject limb pocket mounting arrangement is that the brace height of the bow can be adjusted simply and easily from either the front or back of the bow by turning a single, pocket-mounted bolt or the like to rotate the pocket about its pivot axis.

The distance between butt of the limb and the roller or slide fulcrum is deliberately made long enough to provide a stable platform for the bow limb. This significantly contributes to accuracy by reducing side-to-side movement of the limb and the limb twist which occurs as an arrow is launched due to the sideways pull which is imposed on the buss/control cables at arrow launch so that the arrow can move past those cables without interference.

The novel overhanging limb configuration is furthermore advantageous in that overall limb length and limb angle are no longer major determining factors in a compound bow's brace height. Thus, this system dramatically changes bow design criteria by allowing more choice in riser style (deflexed, straight, or reflexed) and limb length.

The increased limb length and optimum brace height provided by the present invention are important from the viewpoints of arrow speed (which is increased by a shorter brace height) and the ease with which the bow can be shot. In addition, the weight added in front of the riser by the overhanging segments of the limbs stabilizes the bow, typically making it unnecessary to employ accessory stabilizers for bow stabilization.

Limbs with dual belly cuts are preferably employed in the solid limb compound bows disclosed in this document. The two belly cuts are so spaced along the limb that, when the limb is installed in its limb pocket, the front belly cut is ahead of the fulcrum in the pocket and can extend to the butt of the limb and the rear belly cut is behind the fulcrum. In the two working areas provided by the belly cuts the limb is thinner and can readily bend about the fulcrum during the draw cycle. The front and back working areas provided by the belly cuts as a consequence spread the stresses imposed on the bow when an arrow is fired.

Particularly by extending the front working area all the way from near the fulcrum to the butt of the limb, one can, without overstressing the limb and sacrificing structural integrity, store significantly more arrow-propelling energy in the limb as the bow in which it is incorporated is drawn than might be the case if typically available limbs with a shorter front belly cut or a single belly cut or no belly cut at all were employed.

Limbs with double belly cuts can of course also be employed in those bows embodying the principles of the present invention which have split limbs and in other solid and split limb bows as well. For applications which employ fasteners to anchor the limb butts, the butts may be thickened to accommodate a fastener-receiving hole without losing structural integrity.

Limbs which have an asymmetric transverse cross-section or are otherwise stiffer or heavier on one side than on the other side can advantageously be employed in the bows disclosed in this document and also in generally any other bow including compound bows with solid limbs and split limbs and cross bows. The asymmetry minimizes, if it does not entirely eliminate, cam lean. This improves accuracy by keeping the bow string straight during the draw and keeps the string from rolling over and walking back and thereby causing the arrow from being thrown to the side as it is shot from the bow. As discussed briefly above, the poundage of pocket-employing bows disclosed herein is adjusted in a completely novel manner; viz., by pivoting the pockets in which the bow limbs are seated rather than the limbs themselves as is done in a conventional bow in which poundage is adjusted by downwardly displacing a limb-retaining fastener. The poundage adjusting components are accessible from the rear (or optionally front) side of the bow rather than from the bottom and top of the bow as is the case in the usual compound bow. Adjustment from the front or rear of the bow is more convenient and results in a more aesthetically pleasing bow.

Vibration and stress can be significantly reduced by isolating the limbs from their pockets. A further contribution to the reduction of sound and other vibrations can be made by isolating the limb pockets from the riser of the bow. For example, elastomeric O-rings and elastomeric washers can be located between the riser and the side walls of the limb pockets and between the limb pockets and the limb pocket pivot component(s) to isolate the pockets.

Other important features and additional advantages and objectives of the invention will become apparent to the reader from the foregoing and the appended claims and as the ensuing detailed description and discussion proceeds in conjunction with the accompanying drawings.

BRIEF DESCRIPTION OF THE DRAWINGS

FIG. 12 is drawn to an enlarged scale to more clearly show one of two identical plug/shim units and the relationship of that unit to the upper limb, limb pocket, and fulcrum of the FIG. 1 bow;

DETAILED DESCRIPTION OF THE INVENTION

Figure 1:
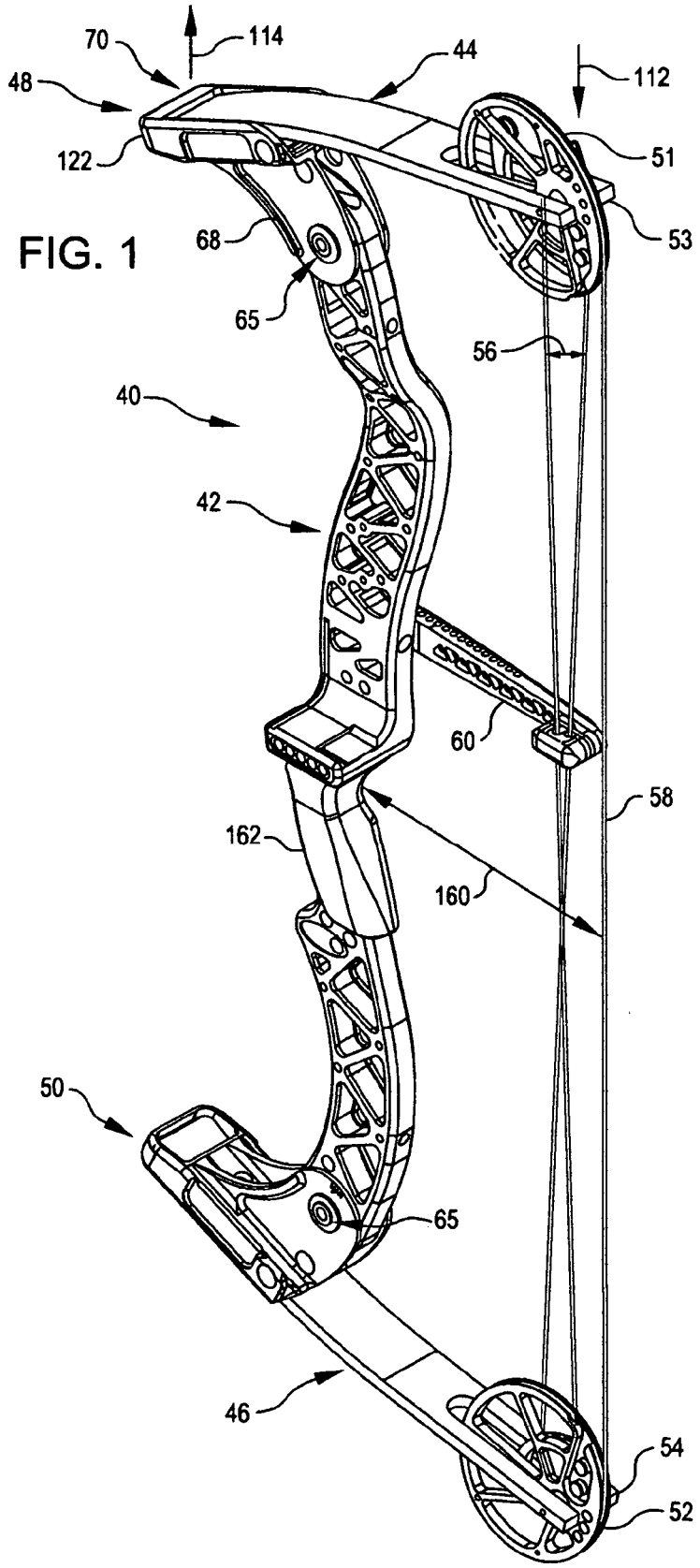
FIG. 1 is a perspective view of a solid limb, hybrid cam, nearly straight riser, compound bow which is constructed in accord with and embodies the principles of the present invention; this bow has limbs leverage locked without fasteners in pivoting limb pockets which extend well forward beyond the front of the riser and cams rotatably mounted on the tips of the limbs; it also has a three-point pocket system.
Figure 2:
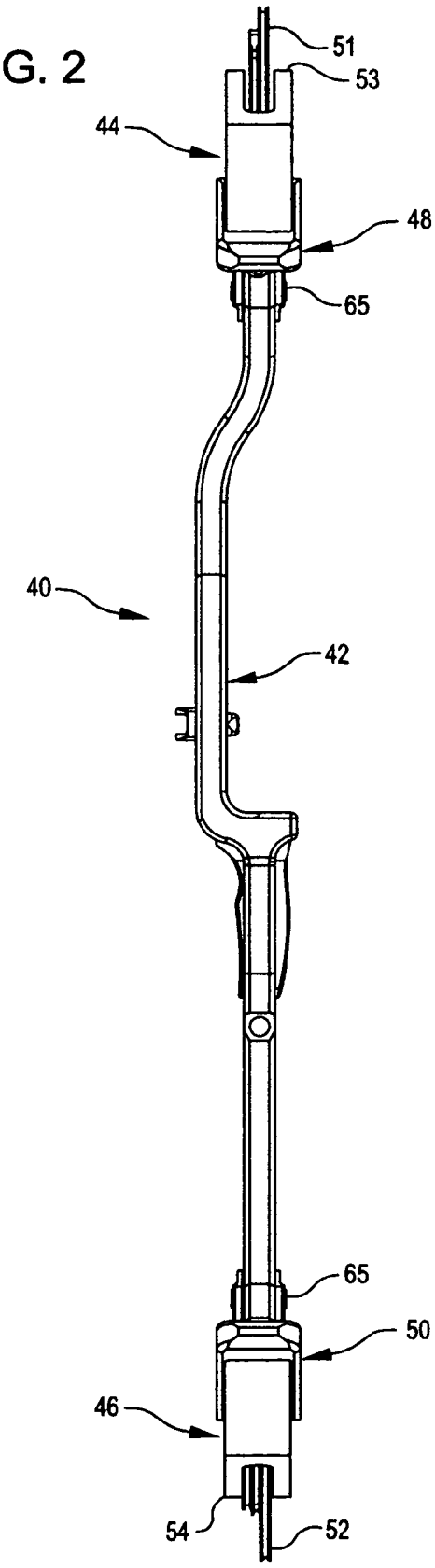
FIG. 2 is a front view of the FIG. 1 bow.
Figure 3:
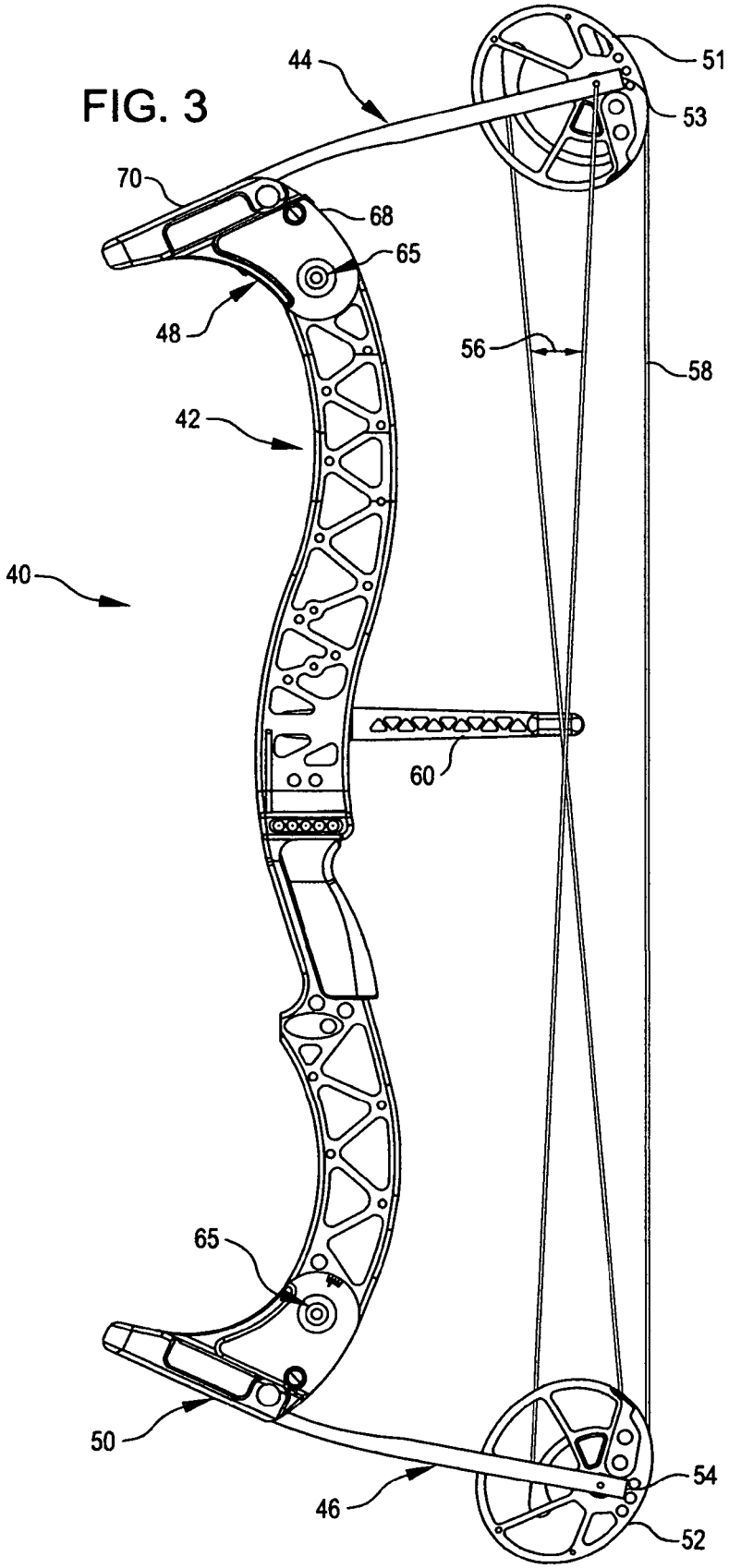
FIG. 3 is a side view of the bow shown in FIG. 1.

Referring now to the drawings, FIGS. 1-3 depict a solid limb, compound archery bow 40 constructed in accord with the principles of the present invention. Bow 40 has a riser 42 and upper and lower limbs 44 and 46 mounted to riser 42 in articulated limb pockets 48 and 50. Rotatable, axle-mounted cams 51 and 52 are mounted to the tips 53 and 54 of limbs 44 and 46. Buss/control cables collectively identified by reference character 56 and a bow string 58 are strung between upper and lower cams 51 and 52, the buss/control cables 56 being trained through a riser-mounted cable guide 60.

Figure 4A:
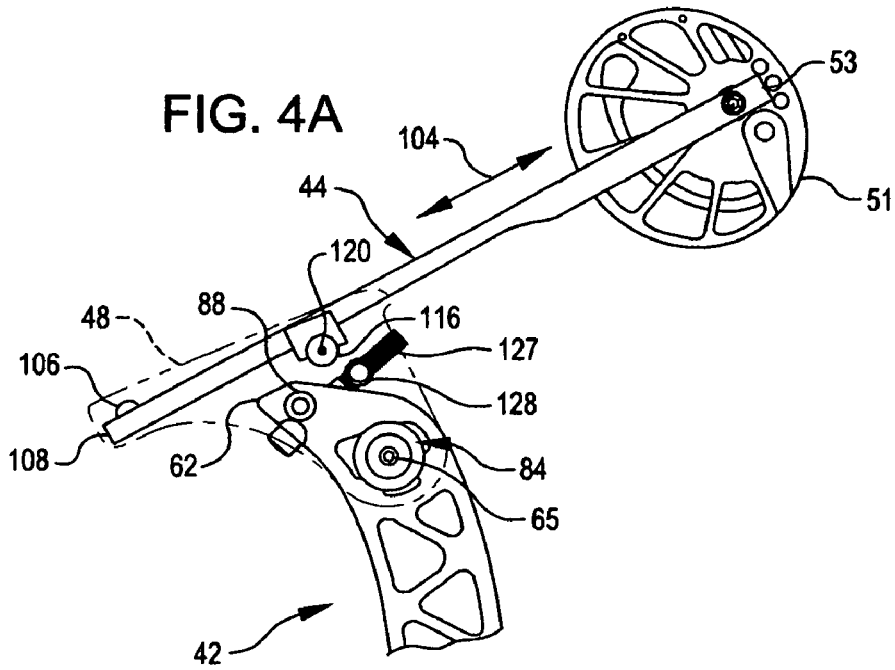
FIG. 4A is a fragmentary, enlarged scale side view of the bow; this view (and also FIG. 1) show, among other components, the riser of the FIG. 1 bow, the upper bow limb and cam, a pivotable limb pocket, components mounting the limb pocket to the riser, and a pocket washer and an elastomeric O-ring which isolate the limb pocket to a significant extent from vibrations set up in the riser when an arrow is launched from the bow; the upper limb pocket is represented by a phantom line in this figure.
Figure 8:
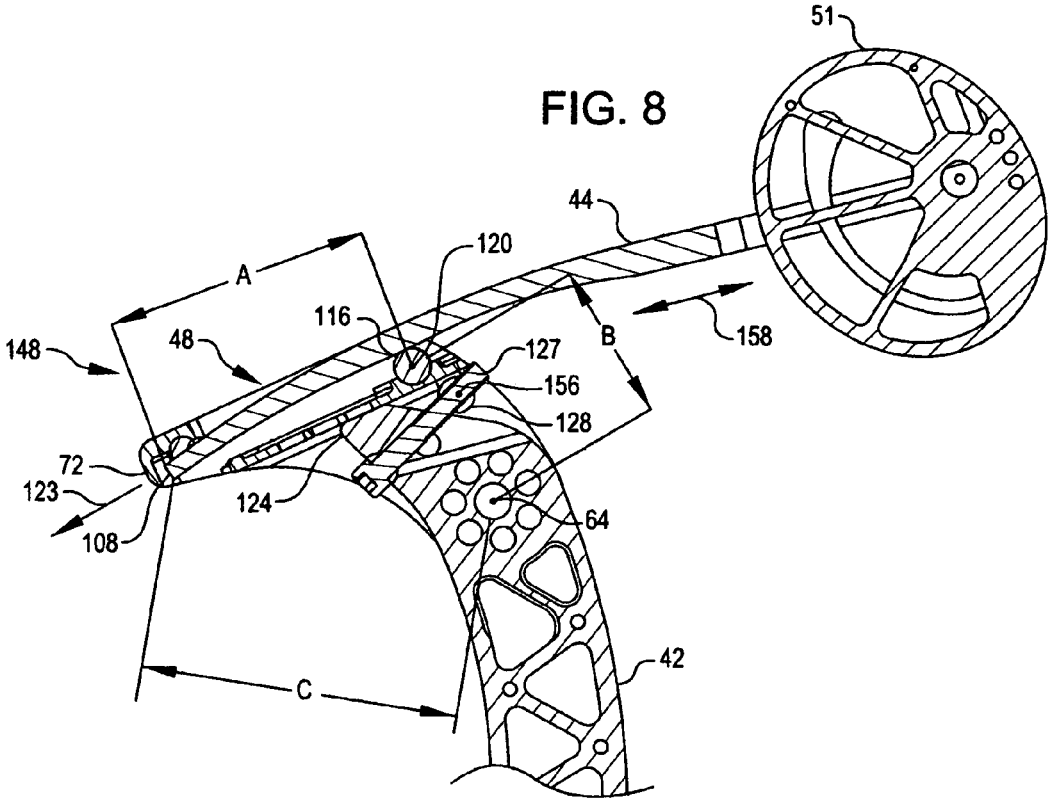
FIG. 8 is a fragmentary section through the upper part of the FIG. 1 bow; this figure is included to show a half-round bow limb anchor mounted on the butt of the upper bow limb and locked in the pivotable upper limb pocket to fixedly position the butt of the limb longitudinally in the in the pocket; a fulcrum about which the limb can flex installed in the limb pocket, the fulcrum also accommodating longitudinal movement of the limb relative to its anchored butt as the bow is drawn and when the arrow is launched and the limb returns to its "rest" configuration; components on which the limb pocket pivots; and a nut-and-bolt system for adjusting the poundage (or poundage and brace height) of the bow which includes a pocket-mounted barrel nut and a rotatable adjustment bolt held against longitudinal movement in the riser and threaded through the adjustment nut and the member on which the limb pocket pivots.

Turning next to FIGS. 4A and 8, limb pockets 48 and 50 are essentially duplicates, and the limb pockets are pivotably mounted to riser 42 in the same manner. Accordingly, only the upper limb pocket 48 and upper bow limb 44 will be described herein, it being understood that this description applies equally well to lower limb pocket 50 and lower limb 46.

Figure 4B:
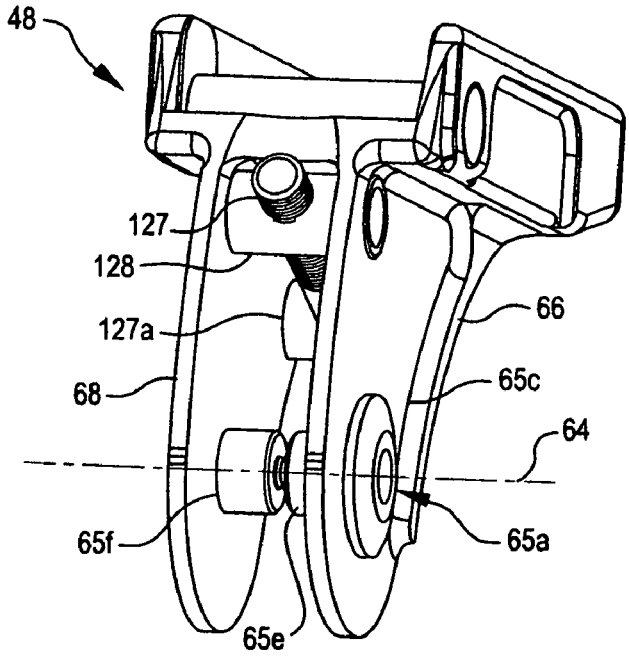
FIG. 4B is a perspective view of the limb pocket.

Upper limb pocket 48, shown in phantom lines in FIG. 4A, is mounted to the upper end 62 of riser 42 for pivotable movement about axis 64 by a transversely oriented collection of components 65, These components, best shown in FIG. 4B, are collectively referred to as a limb pocket pivot assembly.

Figure 7:
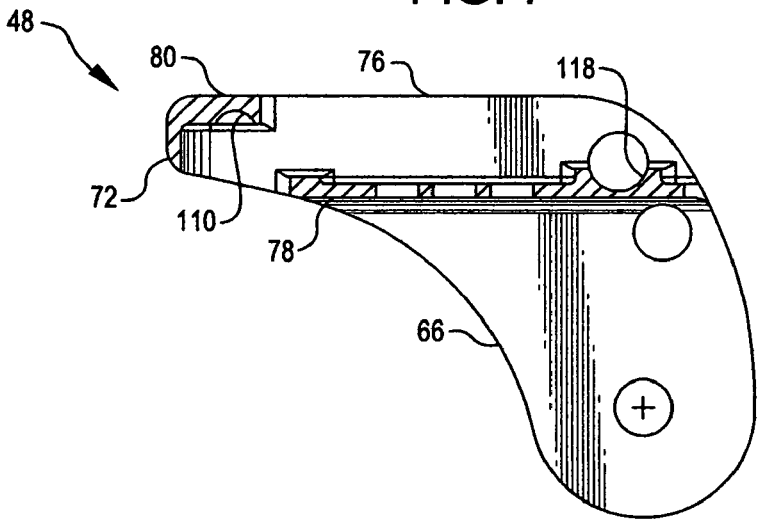
FIG. 7 is a section through the limb pocket.

As is best shown in FIGS. 2, 7 and 8, limb pocket 48 has a pair of transversely spaced flanges 66 and 68. These flanges lie on opposite sides of riser 42.

Integrated with flanges 66 and 68 is a limb butt-receiving pocket component 70 which has a front wall 72 and side walls 74 and 76. Limb pocket component 70 also has a bottom wall 78 and an integral flange 80 located at the upper end of front wall 72 and extending from that wall toward the back of bow 40.

Figure 13:
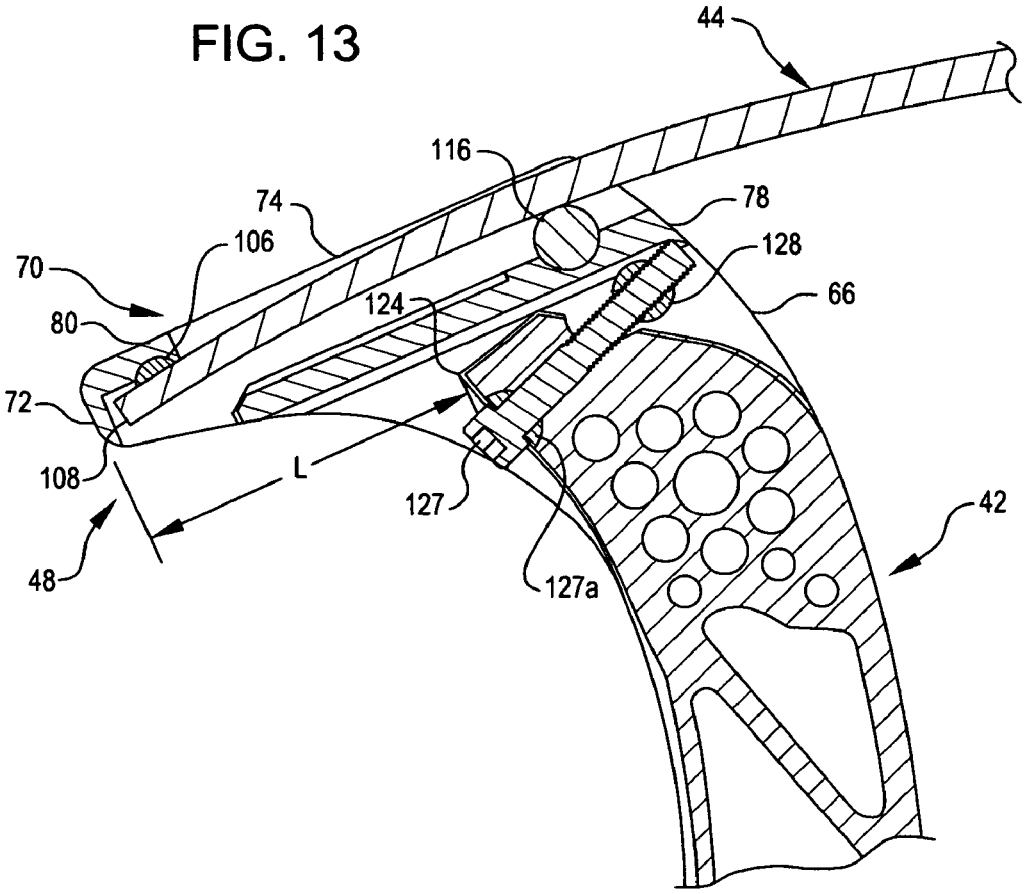
FIG. 13 is a fragmentary, idealized, generally pictorial section through the FIG. 1 bow; it is included to show the relationship of the upper limb pocket and FIGS. 4A, 11, and 12 components housed in that pocket.

As is best shown in FIGS. 8 and 13 and discussed above, limb pocket 48 is pivotably mounted to riser 42 by limb pocket pivot assembly 65. The components of limb pocket pivot assembly 65 include mushroom-shaped elements 65*a* and 65*b* which are mounted to and extend through limb pocket flanges 66 and 68 with heads 65*c* and 65*d* of the elements against the exterior sides of the flanges. Stems 65*e* and 65*f* of elements 65*a* and 65*b* are axially aligned along limb pocket pivot axis 64 between the depending pocket flanges 66 and 68 and support limb pocket 48 for pivotable movement relative to riser 42. A bolt 65*g* extends through elements 65*a* and 65*b*, and is threaded into the stem 65*e* of element 65*a*. Bolt 65*g* can be tightened to clamp flanges 66 and 68 and assembly elements 65*a* and 65*b* together and thereby lock limb pocket 48 at the angle to which it adjusted.

Figure 4C:
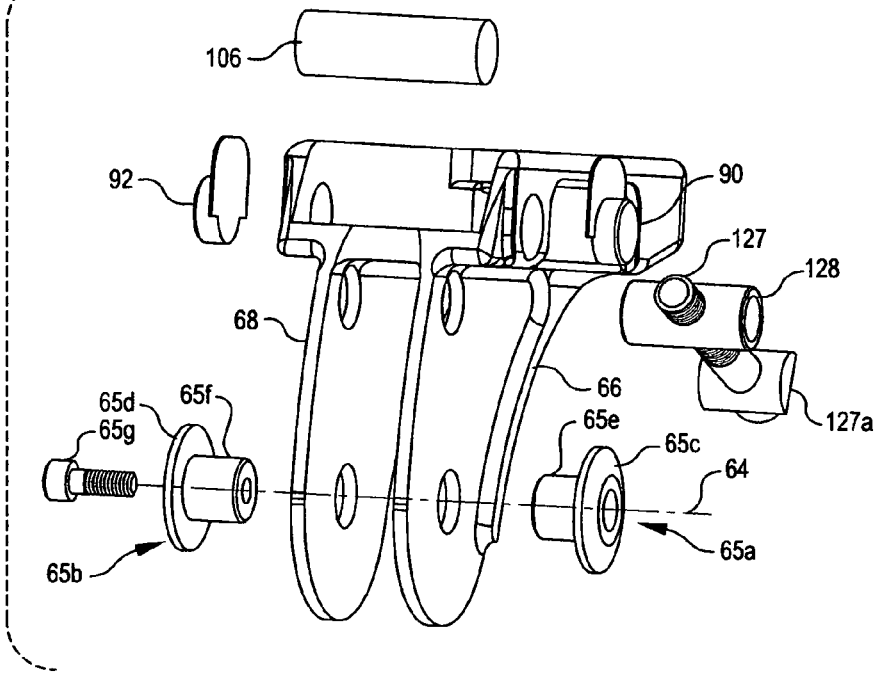
FIG. 4C is an exploded view of the limb pocket.

Elastomeric washers isolate the riser of bow 40 from limb pocket 48. One of these washers is illustrated in FIG. 4 and identified by reference character 84. This washer is interposed between riser 42 and the depending, pocket flange 66. The second washer (not shown in the drawings) is similarly interposed between the riser and pocket flange 68. Third and fourth elastomeric washers (likewise not shown) may, for further isolation, be installed between limb pocket flanges 66 and 68 and the heads 65*c* and 65*d* of associated mushroom elements 65*a* and 65*b*

Riser 42 is further isolated from limb pocket 48 by O-rings on opposite sides of the riser. One of these O-rings is shown in FIG. 4A and identified by reference character 88.

The above-described riser-pocket vibration isolation components 84 and 86 and their counterparts on the other side of riser 42 enhance accuracy, reduce the sound made when bow 40 is shot and reduce the transmission of vibrations from the limb pockets to the riser and from the riser to the shooter's hand.

Figure 12:
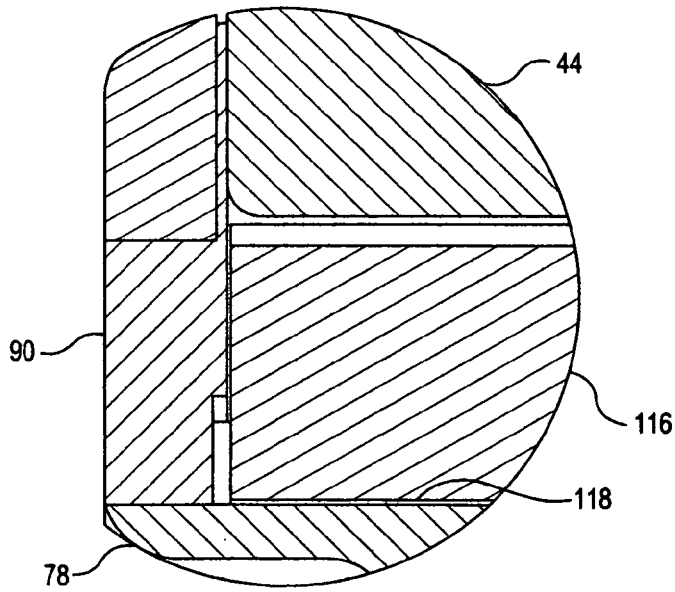
FIG. 12 is a detail of FIG. 11 identified as R in the latter figure.

Shim/end cap units 90 and 92 (see FIGS. 12 and 13) center limbs 44 and 46 in limb pockets 48 and 50 and facilitate the manufacture of bow 40.

Referring now most specifically to FIGS. 4A, 8, and 13 and with particular reference also to FIGS. 1 and 3, limb 44 is leverage locked in pocket 48. More specifically, limb 44 is fixed longitudinally; i.e., in the directions indicated by arrow 104 in FIG. 4A, by a limb butt anchoring system which includes a (typically) half-round anchor 106 fixed to the butt 108 of limb 44. Anchor 106 is locked in a complementary, recessed seat 110 which is formed in transversely extending flange 80 of pocket 48 as shown in FIG. 8.

Once limbs 44 and 46 have been installed in limb pockets 48 and 50, the bow limbs are placed under tension. This in turn tensions buss/control cables 56 and bow string 58 are tensioned, and limb 44 is bent or flexed downwardly; i.e., in the direction indicated by arrow 112 in FIG. 1. This biases the butt 108 of the limb in the upward, arrow 114 direction about a transversely extending fulcrum 116 installed in pocket 48 immediately below and in contact with limb 44. This locks anchor 106 in seat 110.

Also, as bow 40 is drawn, limb 44 moves in limb pocket 48 toward the butt 108 of the limb. To avoid unwanted performance affecting binding or other restraint on limb 44 as it so moves in limb pocket 48, fulcrum 116 is supported in a seat 118 formed in limb pocket bottom wall 78 for rotary or rolling movement about a central axis 120. This, together with the elimination of the limb-securing fastener arrangement commonly employed and its replacement with anchor system 106/110, makes limb 44 active (or live) over substantially its entire length whereas, in a conventional bow, that part of the limb between the fastener and the limb butt is dead. As discussed above, this significantly increases the amount of potential energy which can be stored in a limb of given length when a bow is drawn, leading to lighter and more compact bows.

Anchor 106 and/or fulcrum 116 may advantageously be fabricated from materials with vibration dampening properties. Doing so reduces the shock and vibration felt by the shooter when an arrow is shot and makes the bow quieter.

Referring now to FIGS. 3, 8, and 13, the front end 72 of limb pocket 48 is deliberately extended forwardly in the arrow 123 direction well beyond the forwardmost point 124 of riser 42 such that the the overhang distance "L" between the forwardmost riser point and the limb butt 108 is at least one inch. As discussed above, this significantly reduces overall limb length and limb angle as the major determining factors in a bow's brace height, allowing much more more choice in riser style and limb design.

Bow 40 is assembled by installing limb 44 in limb pocket 48 in the relationship shown in FIG. 4A, for example, and by then similarly installing lower limb 46 in pocket 50. Next, buss/control cables 56 and/or bow string 58 are placed under tension to flex bow limbs 44 and 46 and generate forces which lock anchors mounted to the butts of the limbs in their complementary seats in limb pockets 48 and 50

The installation of representative bow limb 44 is accomplished with the poundage of bow 40 set to zero, advantageously eliminating the need for a bow press to install the limb and its associated cam 51. Buss/control cables 56 and bow string 58 are then placed under tension to load limb 44 and thereby retain it in place with anchor 106 locked against its seat 110 by rotating an externally threaded drive bolt 127 best shown in FIGS. 4, 8, and 13. Adjustment bolt 127 extends through a half-round or equivalent, rotatably displaceable component 127*a* in riser cutout 127*b*, then through a pocket-mounted barrel nut 128 which has complementary internal threads and is positioned between the depending flanges 66 and 68 of limb pocket 48. Consequently, as adjustment bolt 127 is turned, limb pocket 48 and limb 44 are rotated about limb pocket pivot axis 64. As adjustment bolt 127 is rotated, the angle of the bolt changes. Half-round 127*a* accommodates the changes in bolt angle by rotating in riser cutout 127*b*.

In assembling bow 40, adjustment bolt 127 is rotated in the direction which loads limb 44, placing buss/control cables 56 and bow string 58 under tension to leverage lock the limb in place in the manner discussed above. This rotation is continued until bow 40 reaches selected poundage.

Rotation of adjustment bolt 127 in the opposite direction reduces the tension on buss/control cables 56 and bow string 58 allowing limb 44 to relax until, when zero poundage is reached, anchor 106 can be unseated by lifting the limb away from fulcrum 116 or by pushing the butt 108 of limb in a downward direction. Once the anchor 106 is unseated, limb 44 can be removed from limb pocket 48.

Figure 9:
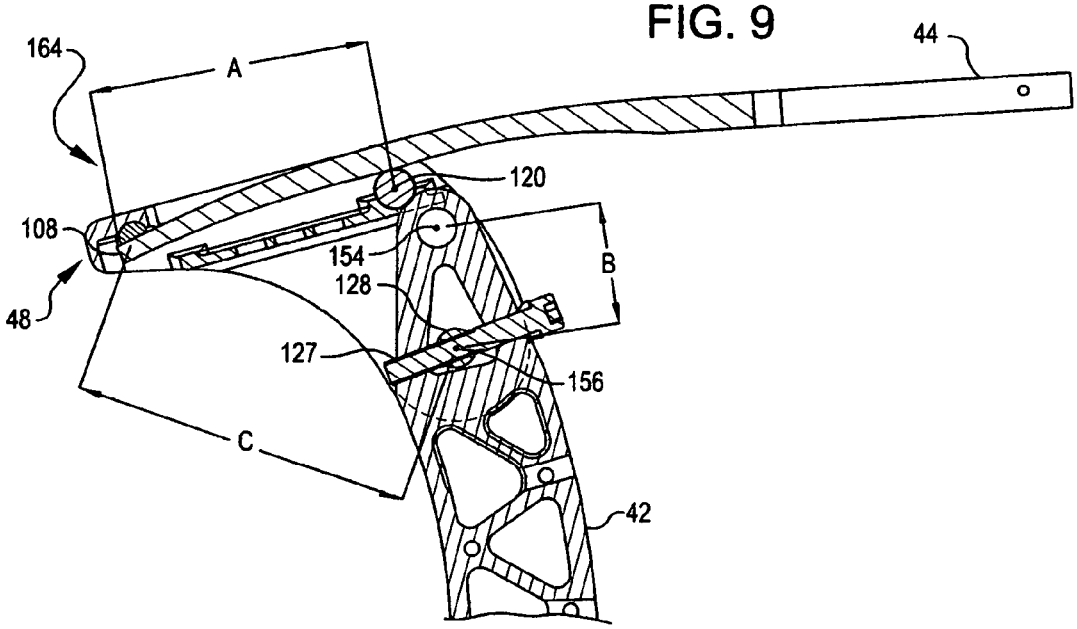
FIG. 9 is a view similar to FIG. 8; it shows a second embodiment of the invention with a three-point pocket system in which the limb pocket pivot axis is located above the limb pocket drive point and between the limb pocket drive point and the fulcrum.
Figure 10:
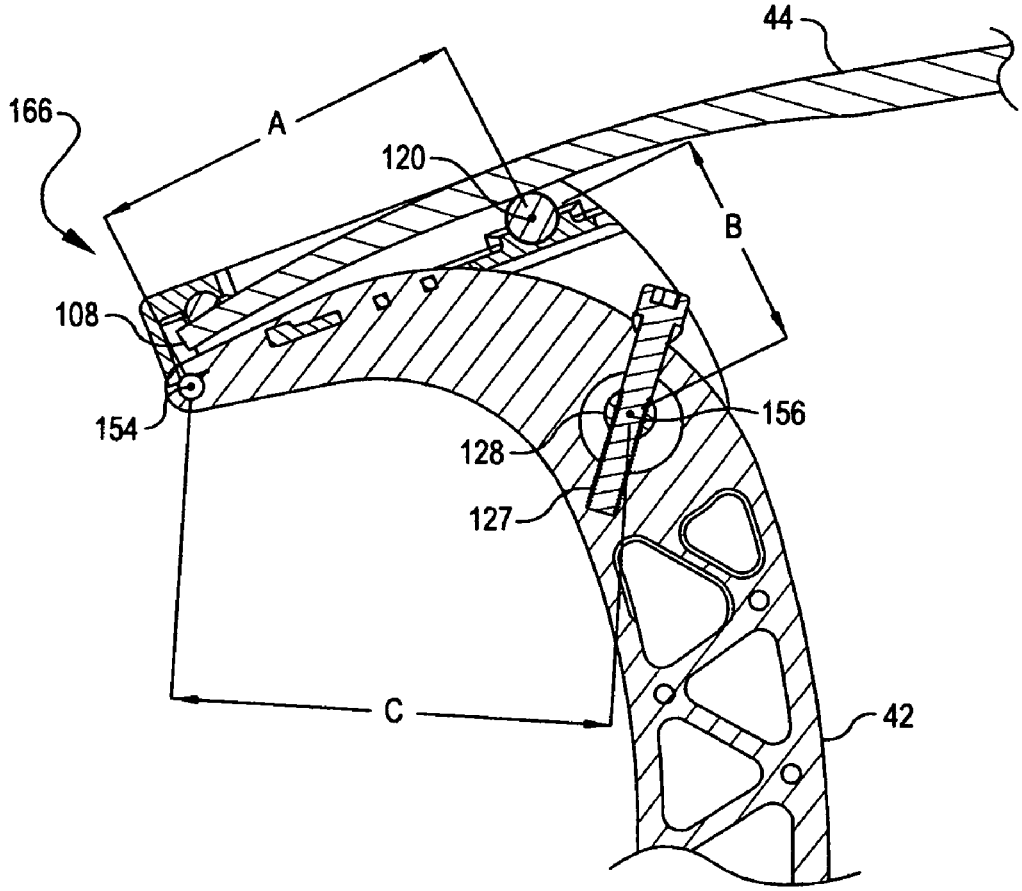
FIG. 10 is a view similar to FIG. 8; it shows a third embodiment of the invention with a three-point pocket system in which the limb pocket pivot point is near the limb butt and the limb pocket drive point is at a significant distance from both the limb butt and the fulcrum.
Figure 11:
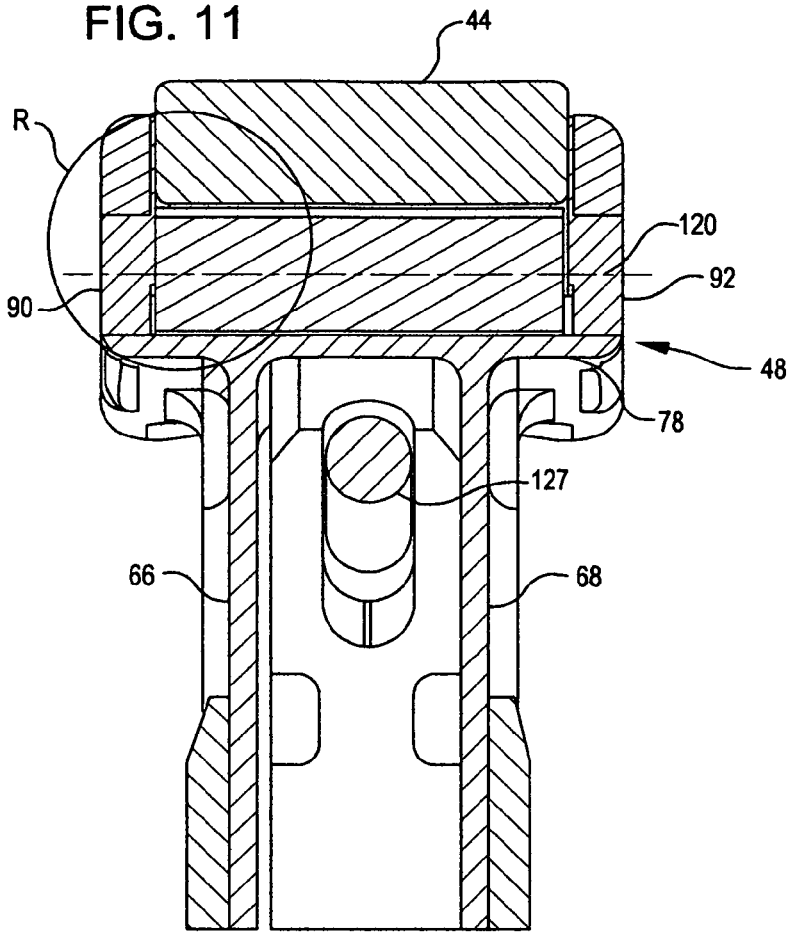
FIG. 11 is a transverse section through the upper end of the FIG. 1 bow; shown among other components, are: the upper bow limb and upper limb pocket, the fulcrum, the poundage adjustment bolt for the upper limb, shims located on both sides of the limb, and plugs (or caps) which are integrated with the shims and are located in holes in the opposite sides of the riser in line with the fulcrum.

The threaded member of the adjustment mechanisms employed in the bows described above may be located for access from either the front of the bow (FIGS. 4A and 8) or the back of the bow (FIGS. 9 and 10). In both cases, adjustment is more convenient and the bow is more aesthetically pleasing than a conventional bow with its top or bottom accessed adjustment features.

Figure 5A:
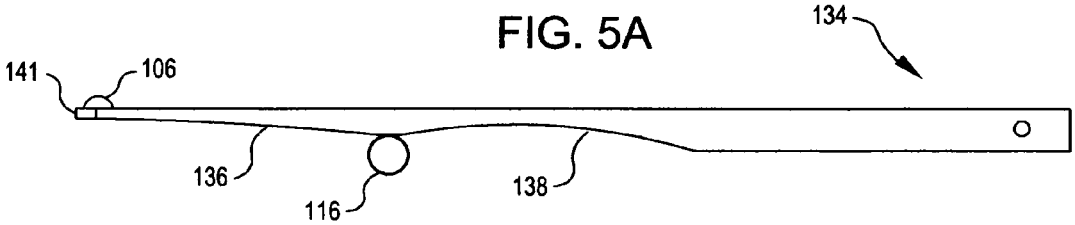
FIG. 5A is a side view of a solid limb with double belly cuts; this limb can be used to advantage in the FIG. 1 bow and in other solid limb bows including those disclosed elsewhere in this document.

An often preferred, solid limb for bow 40 (and other bows including those embodying the principles of the present invention) is shown in FIG. 5A. This limb has double belly cuts and is identified by reference character 134. Its front and back (or fore-and-aft) belly cuts, identified by reference characters 136 and 138, have scooped out configurations. The belly cuts are spaced longitudinally along the limb, creating two working areas where the limb can readily flex. Stresses imposed on the limb as the bow is drawn are spread out in the working areas as determined by parameters including principally the configurations and dimensions of the belly cuts. Spreading out stresses on its limbs as a bow is drawn insures that the stress limits of the limbs are not exceeded. Fore-and-aft belly cuts such as 136 and 138 are much more effective in reaching this goal than the solid limbs with a single belly cut heretofore proposed.

Limb 134 is installed in a limb pocket of a bow such as 40 with belly cuts 136 and 138 on opposite, front and back sides of fulcrum 116 and is employed in other bows in a similar manner; i.e, with the belly cuts on opposite sides of a fulcrum.

Front belly cut 136 extends to and terminates at limb butt 108. This extends the front working area essentially all the way from fulcrum 116 to limb butt 108, enhancing the performance advantages obtained by using the front belly cut. Also, in the case of the widely used, fiber-reinforced limb construction, the absence of a transition zone between the belly cut and the limb butt means that significantly fewer of the reinforcing fibers are cut in the limb manufacturing process; and limb failures that are common and attributable to cut fibers are less likely. Cut fiber ends peel away from the limb; and this materially weakens the limb in the region where the peeling occurs.

Figure 5B:
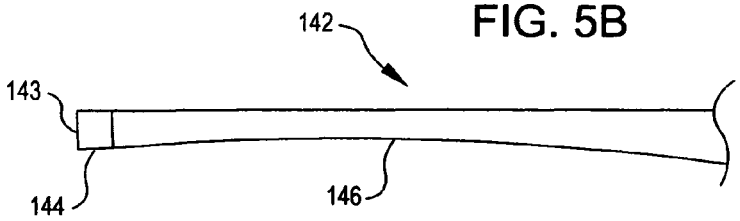
FIG. 5B is a fragmentary side view of a solid limb bow as shown in FIG. 5 but with a thickened butt which allows one to use a fastener to anchor the limb butt.
Figure 6:
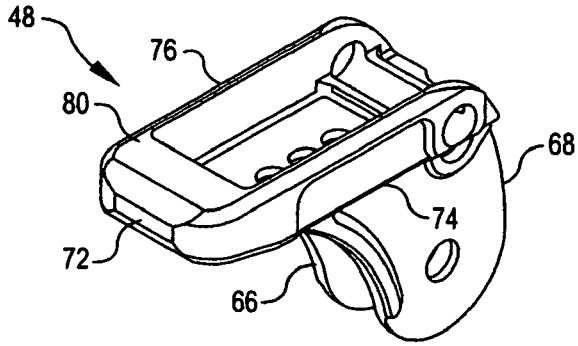
FIG. 6 is a perspective view of the limb pocket.

FIG. 5B depicts, in fragmentary form, a limb 142 which is similar to limb 134 but differs by virtue of its having a thickened limb butt 143 providing structural integrity and stability for fasteners and a transition zone 144 between forward belly cut 146 and limb butt 143. This limb has the same advantages as limb 134, albeit with some sacrifice in performance because the front part of limb 142 in the transition zone 144 between the forward belly cut 146 and limb butt 143 is non-working. Also, because of transition zone 144, limb 142 is at least in principle more susceptible to failure than limb 134.

In a bow having a fulcrum such as bow 40, the distance between the limb butt 108 and fulcrum is increased relative to the comparable distance of a conventional limb so that the limb 134 can be installed with belly cut 136 in front of the fulcrum (component 116 of bow 40) and belly cut 138 in back of or behind the fulcrum. This maximizes the benefits that can be obtained by employing two belly cuts.

Solid limbs with double belly cuts can be used to advantage in virtually any type of bow, not just bows as disclosed in this document.

Referring now to FIGS. 8-10, compound bows embodying the principles of the present invention are characterized by unique, multi-point performance-enhancing, limb pocket systems which have three (or four) points. The four possible points are: (1) the butt of the limb, (2) the central fulcrum axis, (3) the axis about which the limb pocket pivots on the riser, and (4) the limb pocket drive point.

To reiterate, in the novel limb pocket systems disclosed herein, the limb pocket pivot axis and/or the limb pocket drive point are located at substantial distances from the limb butt and the fulcrum of the system. This affords a wide range of poundage adjustment including the reduction of the poundage to zero so the bow can be taken apart without a bow press. Also, the limb pocket systems of the present invention allow one to adjust the brace height of the bow primarily by rotating the pocket adjustment member.

Bow 40 employs a three-point pocket system 148. This system is illustrated in FIG. 8. The three points of the system are labeled with reference characters 108, 120, 64, and 156 (see FIG. 9). 108 is the butt of limb 44, 120 is the central axis of fulcrum 116, and 64 is the limb pocket pivot axis. The distance between points 108 and 120 is labeled A, the distance between points 120 and 64 is designated as B, and the distance between points 64 and 108 is designated as C. To obtain the above-discussed advantages of a three- or a four-point system, both C and B must be greater than one inch in terms of absolute value. In relative terms, both C and B must be greater than A/3. C and B can be greater than one inch and also greater than A/3.

The unique brace height and poundage adjustment capabilities of bow 40 are in part also attributable to the location of limb pocket pivot point 64 beneath drive point 156. As a consequence, the assemblage of limb pocket 42, limb 44, cam 51, buss/control cables 56, and bow string 58 moves toward and away from riser 42 as adjustment component 127 is rotated in one or the other direction (see the double-headed arrow 158 in FIG. 8). The brace height of bow 40, identified by reference character 160 in FIG. 1, is the longest distance between riser 42 and bow string 58. The brace height 160 is therefore increased or decreased by rotation of threaded component 127, depending upon whether the adjustment component is rotated in a clockwise or counterclockwise direction.

A second, also unique, performance-enhancing, three-point pocket system 164 embodying the principles of the present invention is illustrated in FIG. 9. In this system, the limb pocket drive point is identified by reference character 156. Drive point 156 is located at a considerable distance from limb butt 108 and fulcrum axis 120 and on the opposite side of limb pocket pivot point 64 from the fulcrum axis. This arrangement has most of the advantages of the FIG. 8 three-point pocket system 148.

Dimensions A, B, and C are selected to meet the same criteria as the FIG. 8 system 148; i.e., both dimension B and dimension C must be greater than one inch in absolute terms and/or greater than A/3 in relative terms.

FIG. 10 depicts a third, three-point, performance-enhancing, pocket system 166 in accord with the principles of the present invention. The three points of this system are fulcrum axis 120, limb pocket pivot axis 64, and drive point 156. As in the FIG. 9 system 164, the limb pocket drive point 156 is located below the limb pocket pivot point 64. Dimensions A, B, and C of the FIG. 10 system are selected using the same criteria as the dimensions with the same letters in FIGS. 8 and 9; i.e., B and C both greater than one inch and/or greater than A/3

The FIGS. 9 and 10 systems can be employed to change the poundage of the bow with not more than a slight change in brace height. Rotation of adjustment bolt in the FIG. 8 system significantly alters the brace height as the poundage is changed. However, the brace height can be kept the same by swapping out the bow limbs. The riser (and other bow components) do not have to be changed, a decided advantage from the viewpoints of manufacturing costs, inventory, and the like.

The geometry of the pocket systems 148, 164 and 166 illustrated in FIGS. 8, 9, and 10 is not restricted to bows with pivoting limb pockets. These principles of these three and equivalent systems can be employed in the design of any bow with a limb-retention arrangement which allows the butt end of the limb to be displaced relative to the riser in a manner effecting a change in the poundage or the poundage and the brace height of the bow. Also, pocket systems with more than four points can be employed in the bows disclosed herein and in other bows.

Figure 14:
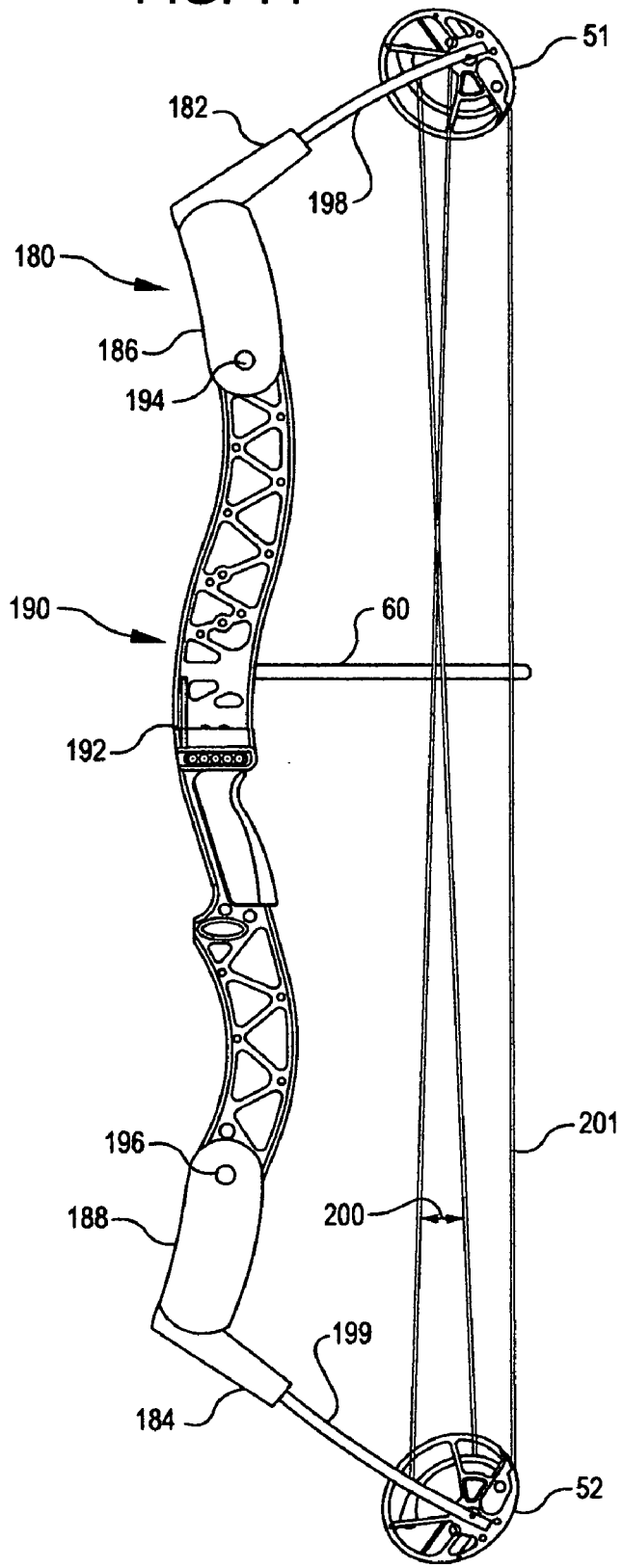
FIG. 14 is a side view of a fourth bow embodying the principles of the present invention; this bow has non-pivotable (stationary) limb pockets and a folding (or articulated) riser; i.e., a riser with end segments which can pivot relative to the central segment of the riser.

One application of the invention with the advantages of the bows discussed above but employing fixed, as opposed to pivotable, limb pockets is the articulated riser bow 180 illustrated in FIG. 14. Components of this bow which are akin to those of the FIGS. 1-13 bow 40 may be identified by the same reference characters.

The upper and lower limb pockets 182 and 184 of bow 180 are immovably mounted to articulated end segments (or components) 186 and 188 of bow riser 190, and the end members 186 and 188 are pivotably connected to a central section 192 of riser 190 by transversely extending pivot members 194 and 196.

Other than being non-pivotable, limb pockets 182 and 184 may be of the construction illustrated in previously discussed embodiments of the invention, for example, those embodiments illustrated in FIGS. 1-13. The upper and lower limbs 198 and 199 of bow 180 may be retained in the limb pockets 182 and 184 by interlocking component anchor systems as described above (not shown in FIG. 14) and by the forces imposed on the bow by tensioning buss/control cables 200 and/or bow string 201 to flex or bend limbs 198 and 199 about fulcrums (likewise not shown) located in limb pockets 182 and 184 in the manner shown in FIG. 13 and other figures and described above.

An adjustment mechanism such as the one discussed above in conjunction with FIG. 4A, but not shown in FIG. 14, can be employed to pivot upper and lower limb pockets 182 and 184 about their pivot members 194 and 196 to change the brace height and/or the poundage of bow 180, making the primary adjustment of brace height and poundage available by manipulating a single component; for example, a threaded drive member as discussed above and identified in FIG. 4A by reference character 127. Three-point pocket systems as described above and illustrated in FIGS. 8-10 can be employed as can pocket systems with four points.

Figure 15:
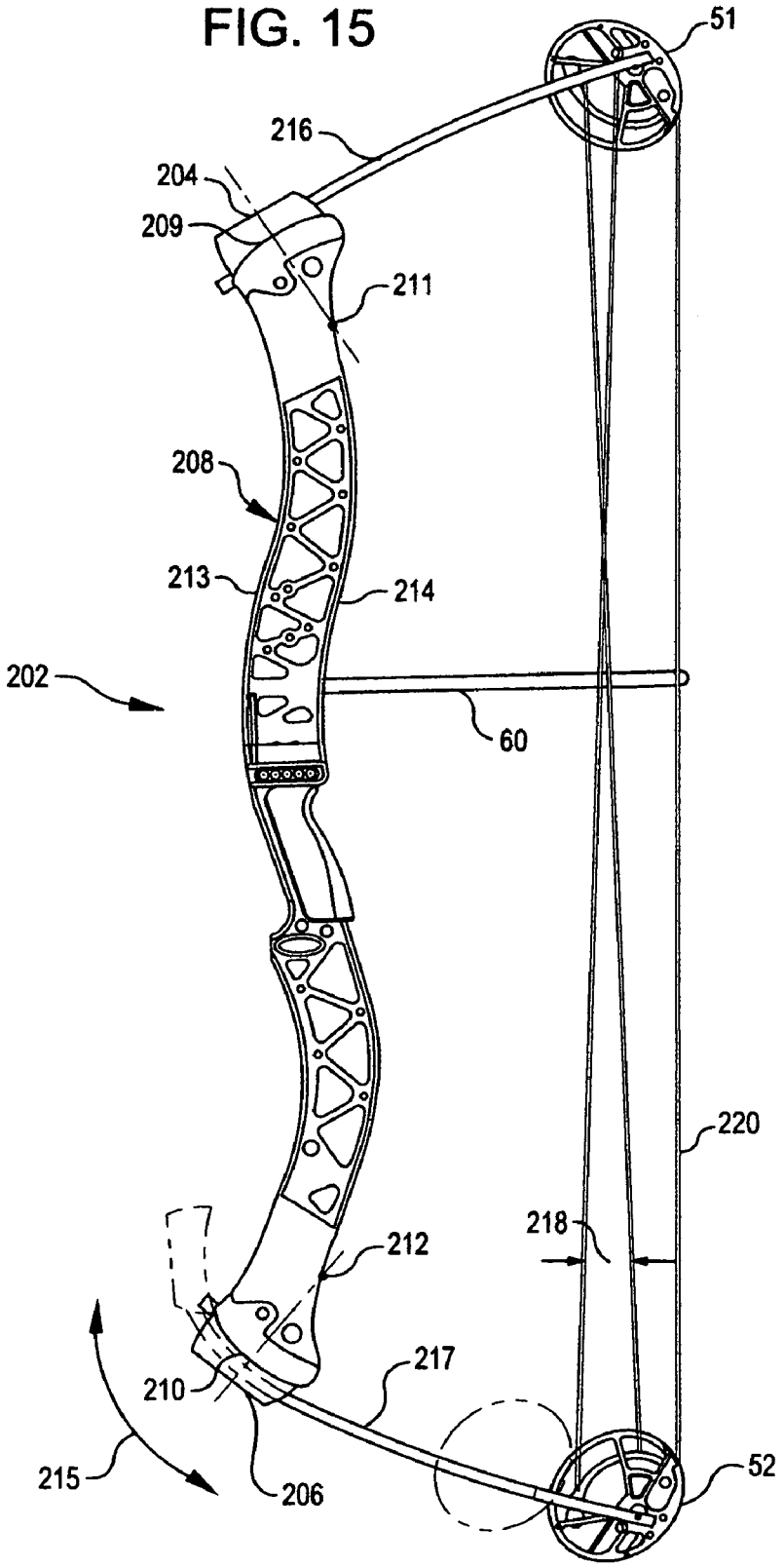
FIG. 15 is a side view of a fifth embodiment of the invention in which the limb pockets translate in fore-and-aft directions along curved paths relative to the riser on which they are mounted during bow draw and upon an arrow being shot rather than being pivotably mounted to the riser.

FIG. 15 depicts a compound bow 202 embodying the principles of the present invention with limb pockets 204 and 206 mounted to the riser 208 of the bow. Riser 208 has upper and lower surfaces 209 and 210 which are arcs of circles with virtual centers 211 and 212. Components of this bow which are akin to those of the FIGS. 1-13 bow 40 may be identified by the same reference characters.

The brace height and/or poundage of bow 202 can be changed by translating pockets 204 and 206 along curved top and bottom riser surfaces 209 and 210 toward the front 213 or back 214 of riser 208 between the limits shown in full and phantom lines at the bottom of FIG. 15, A threaded drive member as discussed above or an equivalent arrangement is used for this purpose.

As in the other bows discussed above, interlocking limb butt anchor systems as described previously and fulcrums about which the limbs can flex may be housed in limb pockets 204 and 206. The butts of upper and lower limbs 216 and 217 may be held in place by: interlocking component limb butt anchor systems and the forces exerted on the butts of limbs 216 and 217 as buss/control cables 218 and/or bow string 220 are tensioned.

Figure 16:
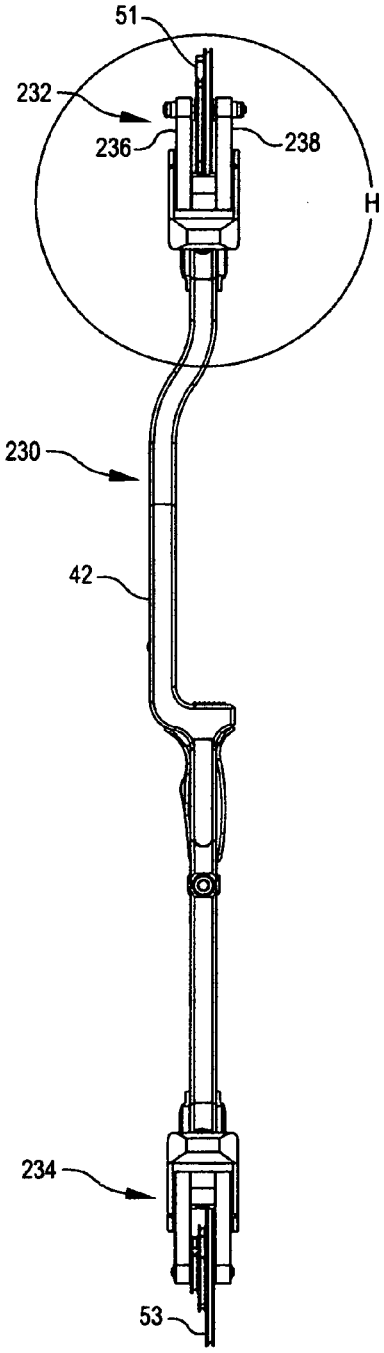
FIGS. 16 and 17 are, respectively, a front view and a side view of a sixth embodiment of the invention, in this case a split limb bow embodying and constructed in accord with the principles of the present invention.
Figure 17:
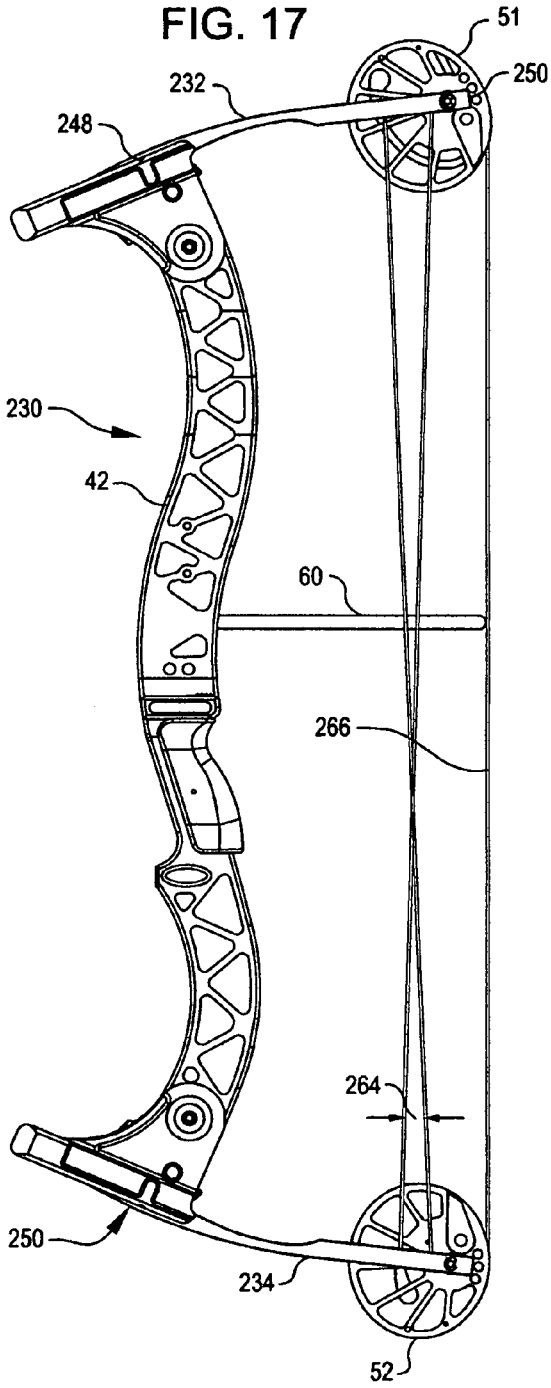
Figure 18:
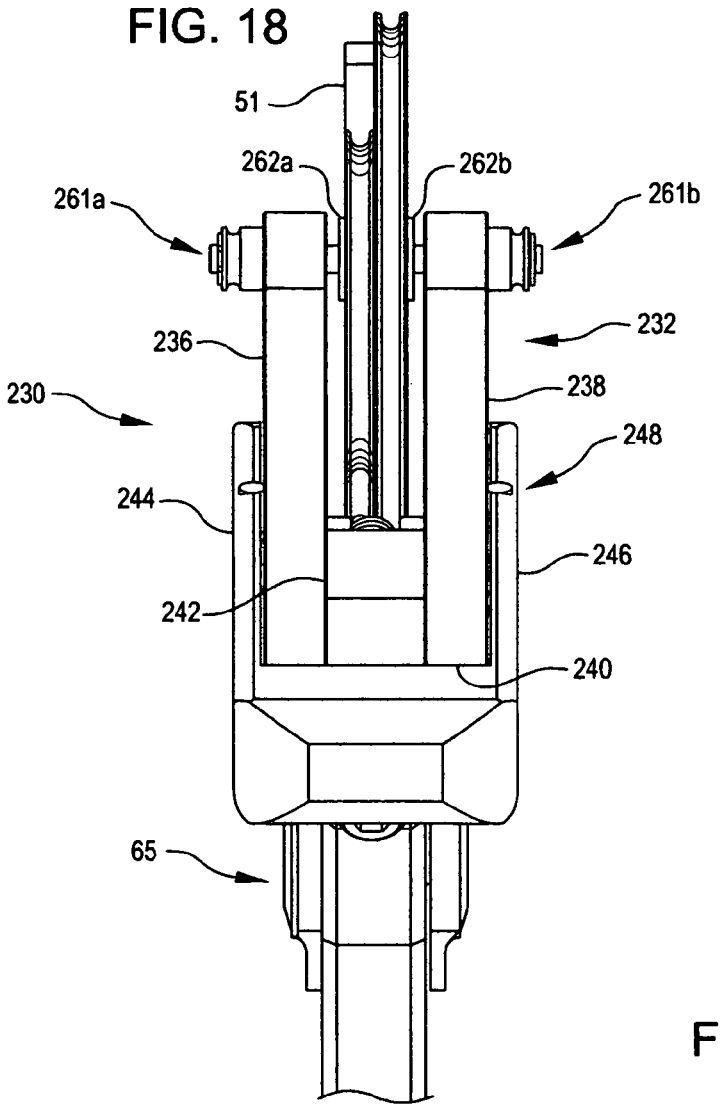
FIG. 18 is detail H of FIG. 16 drawn to an enlarged scale to better show the two branches of the upper bow limb, a cam mounted by a transversely extending axle between the two branches of the limb at the tip of the limb, the pivoting limb pocket in which the butts of the branches are installed, the riser-supported component on which the pocket pivots, and the socketed head of a component for adjusting the poundage of the bow; the bow differs from the FIG. 1 solid limb bow in that each limb is composed of two separate branches and in that a spacer is installed between the butt ends of each limb's branches to space the limb branches apart and fixedly position those ends against the sides of the pocket in which they are socketed.

FIGS. 16-18 depict a compound bow 230 which has upper and lower split limbs 232 and 234 rather than solid limbs as are employed in the previously described embodiments of the invention. Components of this bow which are akin to those of the FIGS. 1-13 bow 40 may be identified by the same reference characters.

The upper and lower limbs 232 and 234 are alike; and, accordingly, only the upper limb 232 is shown in detail (see FIG. 18). Limb 232 has paired branches 236 and 238. At the butt 240 of the limb, branches 236 and 238 may be separated by a spacer 242, preferably fabricated from a vibration dampening material. The limb branches 236 and 238 are clamped against spacer 242 by the side walls 244 and 246 of limb pocket 248.

At the limb tip 290, the paired branches 236 and 238 of limb 232 are transversely spaced along upper cam axle 260. Axle 260 extends through the upper ends of limb branches 236 and 238 (FIG. 18) and into axle retainer units 261*a* and 261*b* located on the outer sides of and butted against limb branches 236 and 238, respectively. Washers 262*a* and 262*b* installed on axle 260 center upper cam 51 between limb branches 236 and 238.

As in the other embodiments of the present invention discussed above, upper and lower limb pockets 248 and 250 of bow 230 may house a limb anchor and a fulcrum (neither shown) about which limbs 232 and 234 of the bow can be bent or flexed to lock the limbs in their respective pockets by tensioning buss/control cables 264 and/or bow string 266.

This unique limb-retention system again allows the brace height and/or poundage to be adjusted by manipulating a single adjustment feature as described above and shown in FIG. 4A and also allows the bow poundage to be reduced to zero to relax limbs 232 and 234. Again, this is highly advantageous in that it allows one to remove the limbs and cams without using a bow press.

One branch of each pair can be made heavier and/or stiffer than the other branch of the pair. This minimizes (or even eliminates) the cam lean caused by a bow's buss/control cable(s) being displaced sideways out of the arrow path when the bow is drawn.

Figure 19:
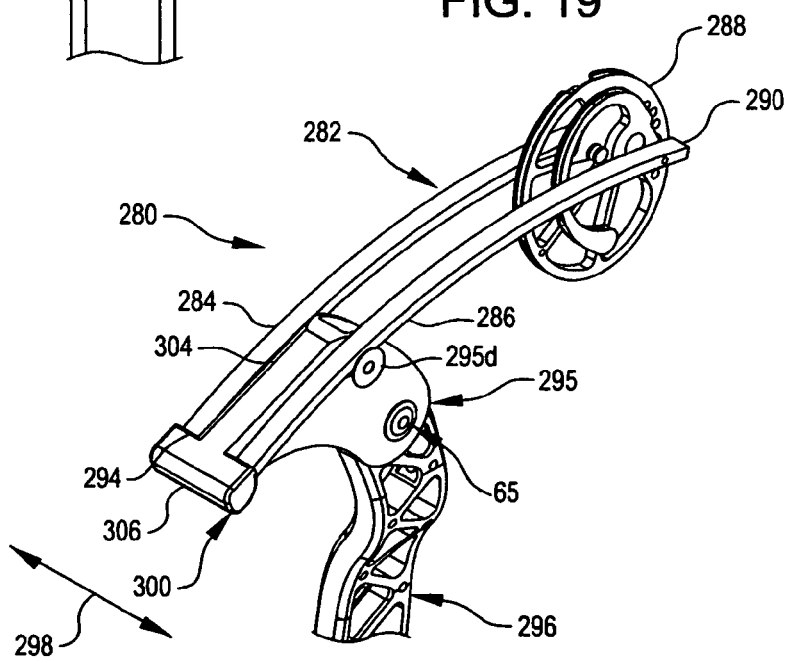
FIG. 19 is a fragmentary perspective view of a seventh bow embodying the principles of the present invention; this bow has split limbs and inside-out limb pockets having stems which are located between the branches of a split limb and limb-branch-positioning cross-pieces.
Figure 20:
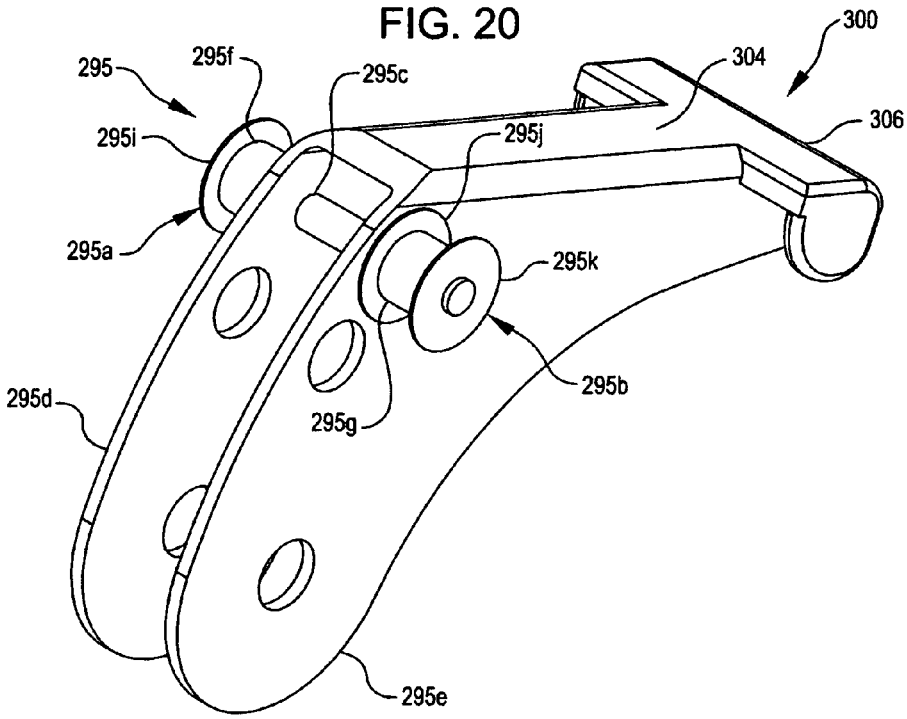
FIG. 20 is a perspective view of the inside-out limb pocket employed in the FIG. 19 bow.
Figure 21:
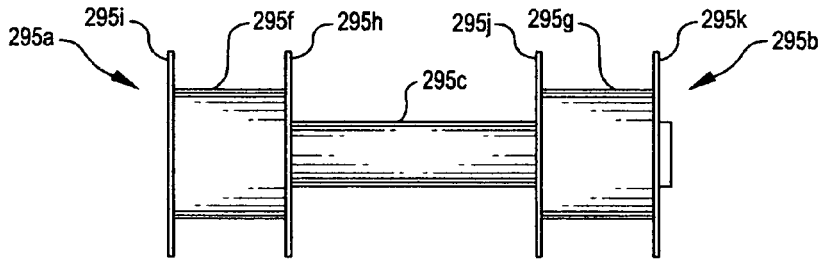
FIG. 21 is a perspective view of bolt and bobbin components of the FIG. 20 limb pocket.

FIG. 19 depicts the upper part of yet another compound bow 280 which employs the principles of the present invention. Like the bow 230 just described, bow 280 has split limbs, the upper limb being identified by reference character 282 and the two branches of the limb by reference characters 284 and 286. Also shown is upper cam 288, rotatably mounted at the tip 290 of the limb between limb branches 284 and 286. The butt 294 of the limb is installed in a limb pocket 295 pivotably connected to the riser 296 of bow 280 by such as the one described above and identified by reference character 65. Bobbins 295*a* and 295*b* are located on opposite sides of the limb pocket against depending limb pocket flanges 295*d* and 295*e*, which embrace the riser 296 of bow 280. Pin 295*c* extends from limb pocket flange 295*d* through riser 296 to limb pocket flange 295*e*. The ends of the pin (not shown) are secured to bobbins 295*a* and 295*b*; for example, with e-clips (not shown).

Bobbin hubs 295*f* and 295*g* are fulcrums about which the branches 284 and 286 of limb 282 bend (or flex) when bow 280 is drawn.

The flanges 295*h* and 295*i* at the opposite ends of bobbin hubs 295*f* and the flanges 295*j* and 295*k* at the opposite ends of hub 295*g* space limb branches 284 and 286 apart in the lateral or transverse directions shown by arrow 298 in FIG. 19.

An inside-out limb pocket component 300 separates and transversely spaces the two limb branches 284 and 286 apart at the butt 294 of limb 282. Inside-out limb pocket component 300 has a longitudinally extending stem 304 and an integral or integrated crosspiece 306. Stem 306 is installed between the branches 284 and 286 of limb 282. Bobbin flanges 295*i* . . . 295*k* hold the branches in place. The butt 294 of limb 282 is mounted to the crosspiece 306 of inside-out pocket component 300.

Inside-out limb pockets have the advantage of being light, simple, and easy to manufacture. An inside-out arrangement of pocket components can be used in two-point, three-point, and four-point pocket systems and in pocket systems with more than four points.

Also, the inside-out arrangement can be incorporated in bows with translating, stationary, and other pockets as well as those bows with pivoting pockets.

The butts of the bows shown in FIGS. 8-10 and 15-19 are positioned at least one inch beyond the front of the riser to which they are mounted to obtain the advantages discussed above in the SUMMARY OF THE INVENTION and DETAILED DESCRIPTION sections of this document.

The advantages of the present invention may of course be realized in many manifestations in addition to those disclosed in the illustrated and above-discussed embodiments of the invention. For example, at some perhaps acceptable sacrifice in the efficiency of the overhanging limb, the limb can be bolted in place. The present embodiments are therefore to be considered exemplary and illustrative and not limiting of the scope of the present invention which is intended to be defined only by the appended claims.

The invention claimed is:

1. An archery bow comprising:

a riser which has a front and a back when the bow is in a shooting position;

limb pockets mounted to opposite ends of the riser;

flexible limbs mounted in the limb pockets;

the limbs having butts which extend at least one inch beyond the front of the riser and;

the limbs being free of pivotable connections to the bow riser.

2. An archery bow as defined in claim 1 in which each of the limbs is functional over substantially its entire length to store energy as the bow is drawn.

3. An archery bow as defined in claim 1 in which the limbs are solid limbs.

4. An archery bow as defined in claim 1 in which the limbs are split limbs.

5. An archery bow comprising:

a riser which has a front and a back when the bow is in a shooting position;

flexible limbs mounted to the riser, the limbs having brace height-dictating end portions that extend beyond the front of the riser; and limb pockets at opposite ends of the riser;

the limb butts being installed in complementary ones of the limb pockets; and the archery bow further comprising limb butt-associated anchor systems retaining the limb butts in the pockets in which the limb butts are installed.

6. An archery bow as defined in claim 5 in which the end portions terminate in butts that are at least one inch beyond the front of the riser.

7. An archery bow as defined in claim 5 in which each limb is functional over substantially its entire length to store energy as the bow is drawn.

8. An archery bow as defined in claim 7 in which the limbs are solid limbs.

9. An archery bow as defined in claim 7 in which the limbs are split limbs.

10. A method of assembling an archery bow which has: (a) a riser with a front and a back, and (b) limbs having butts mounted to opposite ends of the riser;

the method comprising the steps of:

mounting the limbs relative to the riser with the limb butts extending beyond the front of the riser a distance effective to dictate the brace height of the bow; and mounting the limb butts relative to the riser by installing the limb butts in riser-associated limb pockets.

11. A method of assembling an archery bow as defined in claim 10 in which the limbs are mounted with the limb butts extending at least one inch beyond the front of the bow.

12. A method of assembling a bow as defined in claim 10 which includes the step of mounting the limb butts relative to the riser with mechanical systems which allow each flexible limb to be active over essentially its entire length as the bow is drawn.

13. A method of assembling a bow as defined in claim 10 in which the limbs are solid limbs.

14. A method of assembling a bow as defined in claim 10 in which the limbs are split limbs.

* * * * *